United States Patent [19]

Ruf

[11] 4,114,571

[45] Sep. 19, 1978

[54] MEANS FOR CONTROLLING THE OIL COOLING OF THE PISTON OF A PISTON ENGINE

[76] Inventor: Max Ruf, Römerstrasse 11, Obereisesheim, Fed. Rep. of Germany

[21] Appl. No.: 730,298

[22] Filed: Oct. 7, 1976

[30] Foreign Application Priority Data

Oct. 16, 1975 [DE] Fed. Rep. of Germany ..... 2546273

[51] Int. Cl.[2] ..... F01M 1/02; F01D 3/06; F16N 13/22

[52] U.S. Cl. ..... 123/41.35; 123/196 AB; 184/6.22; 165/35

[58] Field of Search ..... 123/196 AB, 41.33, 196 M, 123/41.35, 179 A; 165/35, 36; 184/6.22, 104 B

[56] References Cited

U.S. PATENT DOCUMENTS

| | | | |
|---|---|---|---|
| 2,800,119 | 7/1957 | Schmidl | 123/41.35 |
| 2,874,804 | 2/1959 | Haas | 184/104 B X |
| 3,065,743 | 11/1962 | Brehm et al. | 123/41.35 X |
| 3,221,718 | 12/1965 | Isley | 123/41.35 X |
| 3,465,847 | 9/1969 | Donath et al. | 123/196 AB X |
| 3,990,424 | 11/1976 | Miersch et al. | 123/196 AB |
| 4,010,718 | 3/1977 | Stewart | 123/41.35 |
| 4,027,643 | 6/1977 | Freenan et al. | 123/196 AB |

FOREIGN PATENT DOCUMENTS

| | | | |
|---|---|---|---|
| 1,179,703 | 1/1970 | United Kingdom | 123/196 AB |

*Primary Examiner*—David H. Brown
*Attorney, Agent, or Firm*—Miller & Prestia

[57] ABSTRACT

Means are provided for controlling the oil cooling of the piston of a piston internal combustion engine with a lubricant circuit which contains a pump and an oil cooler and from which a branch pipe for cooling oil for the piston branches off.

7 Claims, 5 Drawing Figures

MEANS FOR CONTROLLING THE OIL COOLING OF THE PISTON OF A PISTON ENGINE

BACKGROUND OF THE DISCLOSURE

An arrangement is known (German DT-OS No. 1,807,639) in which the piston exposed to the combustion process is cooled by lubricant taken from the lubricating circuit. For this purpose a cooling oil pipe leading to the piston is connected through a spring-loaded valve to the lubricating oil circuit, this valve only opening when the oil pressure reaches a predetermined level, which is achieved at a predetermined speed of the lubricating oil pump connected to the engine. In this way, particularly in the lower speed range, unwanted excessive cooling of the piston is avoided and the lubricating oil pressure is maintained at a level sufficient for supplying the lubricating circuit feeding the components that require lubrication.

In such an arrangement, however, after a cold start the cold and accordingly viscous nature of the lubricating oil can lead to an increase in the pressure of the oil so that the spring-loaded valve opens even at a low engine speed and already results in the piston being cooled under these operating conditions. However unwanted cooling of the piston also occurs when running at a higher speed after a cold start. This cooling of the piston, however, significantly delays the attainment of the operating temperature so that in this phase of operation there is an increase in the fuel consumption and unfavorable exhaust gas conditions arise. Moreover, as the lubricating oil circuit is also fed through an oil cooler the warming up phase can experience a further delay, in particular at low external temperatures. A further drawback lies in the fact that when the engine is hot, both under idling conditions and also at high loads and low speeds, no cooling of the piston, necessary in itself, can take place as the lubricant pressure under these conditions of operation is not sufficient for supplying the piston cooling.

SUMMARY OF THE INVENTION

The invention is based on solving the problem of overcoming the stated drawbacks and of providing an arrangement of the kind stated in the introduction above by which the engine reaches its operating temperature in a short period of time and which regulates the cooling of the piston in accordance with the temperature of the lubricating oil but independently of pressure.

The solution to this problem, is, according to the invention, characterized by a control member which regulates both the supply of oil to the piston and also the flow of oil through the cooler in accordance with the temperature of the oil.

By this arrangement it is possible that at low temperatures no oil passes through the cooler and at the same time there is no cooling of the piston, even when the lubricating oil pressure is made high by its high viscosity or on account of a high running speed. By shutting off the supply of cooling oil to the piston, especially at low temperatures, on the contrary a rapid rise in the piston temperature can be obtained and accordingly a more economical manner of operation of the engine can be achieved. Then only after the operating temperature has been reached can the cooling of the piston and also the cooler itself be put into operation by the control member. When, on the other hand, under an operating condition such as for example occurs in idling or on the overrun, there is a fall in temperature, the supply of cooling oil to the piston can be cut off again by the control member. By this proposed arrangement by which the operating temperature can be reached after a short period of time and can also be maintained, it is possible to achieve a reduction in the cold wear, an improvement in the exhaust gas quality, and a reduction in the fuel consumption.

The control member can on the one hand be arranged between a lubricant pipe leading to the bearings of the engine and to the oil cooler and a by-pass pipe which circumvents these and on the other hand between the lubricant pipe and the cooling oil pipe leading to the piston and can have a first operative position in which the connection between the lubricant pipe and the by-pass pipe is open and the connections both between the lubricant pipe and cooler and also between the lubricant pipe and the cooling oil pipe leading to the piston are closed off and can be movable by a thermal element into a second operative position in which the first connection is shut off and the second connection is opened.

By means of this layout in the first operative position, in which the control member is at a low temperature, the lubricating oil is guided through the by-pass pipe that circumvents the cooler and it passes directly into the lubricant circuit without the lubricant or the piston being able to be cooled. On attainment of the operating temperature sensed by the thermostat, the control member can be shifted into its second position in which, by contrast, the flow of lubricant through the by-pass is cut off, the path through the cooler is opened and simultaneously the supply of cooling oil to the piston is opened.

The control member can be formed by a valve spool mounted in a housing and having at one end a piston face lying in a pressure space connected to the cooler and capable of connection to a return circuit through a valve co-operating with a thermal element which is opened by temperature exceeding a predetermined value, the spool being urged, when the valve is open, under the action of a spring from the first operative position to the second.

By this construction the lubricating oil which is under pressure when the engine is running can pass into the pressure space whereby the spool is shifted into the first operative position, in which only the path of lubricating oil through the by-pass to the lubricant circuit is open. When the temperature rises above a predetermined value the pressure of the lubricating oil in the pressure space is reduced by the valve, actuated by the thermal element, opening it to the return circuit, so that the spool is shifted by the spring to the second position, in which lubricant can pass through the cooler into the lubricant circuit and at the same time cooling oil can reach the piston.

In detail the control member can be of a construction in which the spool has a longitudinal bore which is in communication with the return circuit through transverse bores and within which a piston slide valve is arranged with a longitudinal bore opening into the pressure chamber and in a first position connects that chamber to the transverse bores whilst in a second position this connection is cut off and it includes a spring thrust plate disposed in the pressure chamber, on which a spring abuts, which urges the piston valve member into its second position, and the thermal element is in the form of a bimetallic disc which is mounted between the thrust plate and a face on the spool and acts at a predetermined temperature to urge the piston valve member into its first position against the action of the spring.

By means of this compact and space-saving layout the piston valve mounted in the spool and forming the valve that communicates with the pressure chamber, can be closed under the action of the spring at low temperatures and be opened by the bimetallic discs under the action of heat, and then, on operation of the engine with the piston valve closed the spool is in its first operative position and with the piston valve open and allowing the lubricant present in the pressure chamber to flow away through the spool, the spool is displaced into its second operative position.

There is however also another possible solution in which the end of the spool opposite the pressure chamber lies in a chamber connected to the return circuit and communicating with the pressure chamber through a longitudinal bore in the spool and the valve is arranged in the return chamber and has a valve member which co-operates with the mouth of the longitudinal bore and which is acted on in the closing direction by the spring that acts on the spool and is secured to an expansion element which, at a predetermined temperature, lifts the valve member away from the mouth of the longitudinal bore. Again with this construction, which is distinguished by compact layout, the valve mounted in the spool can be closed by the spring at low temperatures and opened under the action of heat, whereby, on operation of the engine with the valve closed, the spool is in its first operative position and with the valve open, when the lubricant present in the pressure chamber can flow away through the return circuit via the spool, the spool is displaced into its second operative position.

So that the lubricant can act as a heat transfer medium directly on the expansion element there is provided in the spool a passage which on the one hand opens into the return chamber and on the other hand in the first operative position is connected to the by-pass pipe whilst in the second operative position it is connected to the cooler. In this way in the first operative position the expansion element can be acted upon directly by the relatively rapidly heated oil supplied through the by-pass pipe so that the valve responds rapidly and no delay can arise in the control of the supply of cooling oil to the piston. By contrast, when the temperature falls in the second operative position of the spool in which the expansion element can have flowing over it the lubricant supplied through the cooler closure of the valve can take place without delay, the spool being shifted back to its first operative position by the pressure of the lubricant.

There can be provided in the spool, parallel to its longitudinal bore, an auxiliary passage which connects the pressure chamber side to the return chamber and in which is mounted a fusible plug closing this auxiliary passage. This fusible plug can prevent the possibility that on failure of the expansion element the spool, despite a rise in temperature, remains in its first operative position in which the supply of cooling oil to the piston is shut off. Melting of the plug results in the spool being shifted into its second operative position and remaining permanently there so that cooling oil is always fed to the piston. It is true that this leads to a noticeably slower warming up of the engine but it avoids any damage through overheating.

In order now to be able to produce the corresponding connections between the various lubricant pipes and the cooling oil pipe in a suitable manner according to the operative condition of the engine, it is provided that the spool is cylindrical and can slide in a cylindrical bore in the housing, a first port connected to the cooler is provided in the wall of the cylindrical bore, a second port connected to the by-pass pipe, third and fourth ports connected to the lubricating oil pipe and a fifth port connected to the cooling oil pipe, and the spool has on its external surface a first and a second annular groove and in the first operative position the first groove connects the second and third ports whilst the remaining ports are closed off by the spool and in the second operative position the first groove connects the first port to the third port and the second groove connects the fourth port to the fifth port, whilst the second port is closed off by the control spool.

BRIEF DESCRIPTION OF THE DRAWINGS

Some embodiments by way of example and further details and features of the invention are further described in the following description in conjunction with the drawings, in which.

DETAILED DESCRIPTION

Figure 1:
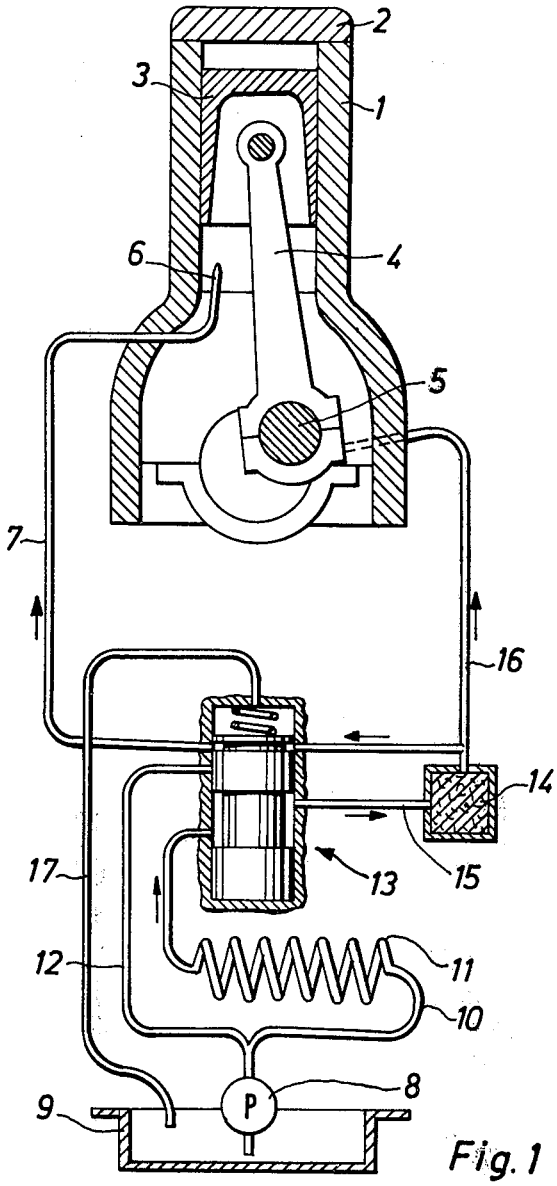
FIG. 1 shows diagrammatically the overall layout of a system with a control member for regulating the piston cooling of a piston engine.

Reference is made first to FIG. 1 in which there is illustrated diagrammatically the overall layout of the system with a piston internal combustion engine comprising substantially a cylinder block 1 with a cylinder head 2 and containing a piston 3 driving a crank shaft 5 through a connecting rod 4. For cooling of the piston there is provided in the block 1 a spraying nozzle 6 which points towards the inside of the piston 3 and is connected through a cooling oil pipe 7 to the lubricating oil circuit. To supply the lubricating oil circuit there is a pump 8 which delivers oil from a sump 9, which is normally secured to the cylinder block 1, but for purposes of clearer illustration of the overall layout of the invention is shown separately from the cylinder block 1. Leading from the pump 8 there are both a oil pipe 10 passing through a cooler 11 and also a by-pass pipe 12 which circumvents the cooler and they both lead to the control member 13. From the member 13 a lubricating oil pipe 15 leads to a filter 14 from which a further lubricating oil pipe 16 leads to the bearings of the engine. Branching from the pipe 16 after the filter 14 is the cooling oil pipe 7 which likewise passes through the control member 13. In addition the control member 13 is connected to a return pipe 17 leading back to the sump 9. In the illustration the control member lies in its second operative position, described in more detail later, in which the lubricating oil flows in the direction of the arrow through the cooler 11 and both to the bearings and also to the cooling oil pipe 7.

Figure 2:
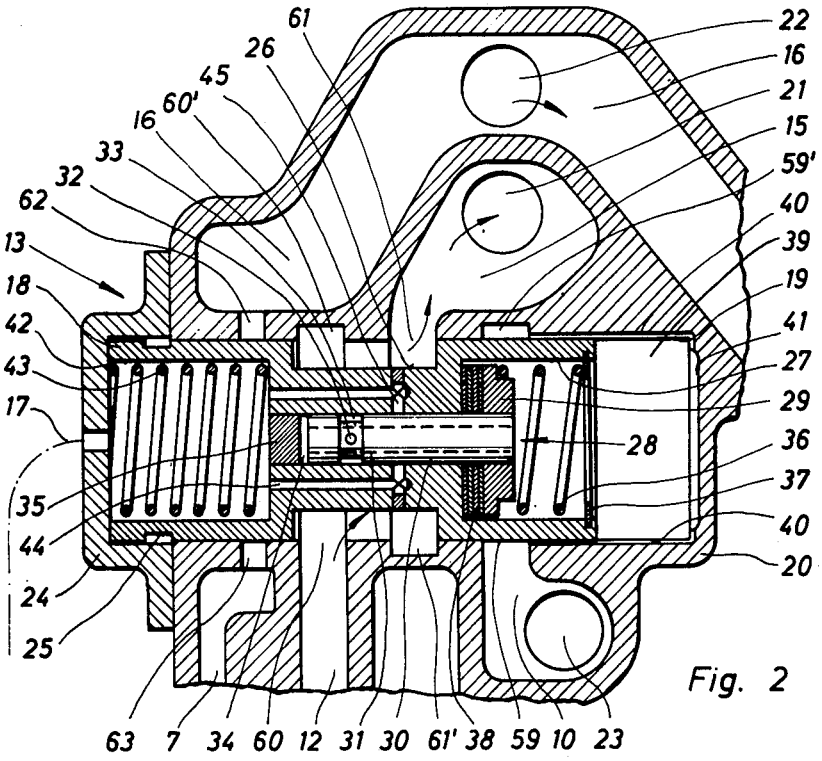
FIG. 2 is a longitudinal section through the control member mounted in the housing, shown partially, of the engine, showing a first operative position.

In FIG. 2 is illustrated the control member 13 comprising a control slide in the form of a spool 18 mounted in a cylindrical bore 19 in a housing 20 and movable longitudinally between two end positions. The housing 20 may for example be part of the cylinder block 1 of the engine, and the pipes illustrated in FIG. 1 as leading into the bore 19 may to some extent be formed as passages cast in the housing 20. Here the oil pipe 10 which passes through the cooler 11 and enters through the passage 23 opens into the port 59 and the by-pass pipe 12 opens into the port 60 in the wall of the bore 19. From the port 61 in the bore 19, which lies between and opposite the ports 59 and 60, the lubricating oil pipe 15 leads through the feed passage 21 to the filter 14 and through the return passage 22 from the filter 14 to the lubricating oil pipe 16 leading to the bearings of the engine. The cooling oil pipe 7 branches off from the lubricating oil pipe 16 and likewise opens into the bore 19 through a port 62 and extends onwards to the opposite side through the port 63. To increase the cross-sectional area for flow there is joined to each of the ports 59, 60, 61 in the wall of the bore 19 a respective circumferentially extending annular passage 59', 60', and 61'. The bore 19 is closed by an end cover 24 to which the return pipe 17 is connected. The spool 18 has a narrow annular groove 25 and a wide annular groove 26 and contains a valve member 28 which is mounted in a recess 27 machined axially in the right hand end as viewed in the drawing. The valve member 28 comprises a flat head or spring-engaging portion 29 and a piston-like stem 30 which is connected to it and which has a bore 31 right through it, the bore being connected through radial bores 32 near its left hand end to an annular groove 33. The stem 30 of the valve 28 is mounted to slide in a bore 34 which passes centrally through the spool 18 and is closed at its one end by a plug 35. By means of a compression spring 36 which abuts against a ring 37 of which the outer periphery engages within the recess 27, the valve head 29 is urged against a number of bimetallic discs 38 which are inserted between the head 29 and the base of the recess 27 to form a thermally responsive element. The outside face of the head 29 and the end 41 of the bore 19 partially define a pressure chamber 39 which is in communication with the port 59 and the oil pipe 10 through longitudinal grooves 40 provided in the wall of the bore 19. On the end of the valve spool 18 which is furthest from the pressure chamber 39 and the head 29 there is likewise provided a recess 42 containing a spring 43 which abuts both against the cover 24 and also against the base of the recess 42. Provided in the base of the recess 42 there are axially extending bores 44 which are arranged around the bore 34 and at their ends that lie near the valve 28 are connected to the bore 34 through radial bores 45.

When the engine is running and after a cold start the valve spool 18 takes up the first position, shown in FIG. 2. In this position the oil pump 8 shown in FIG. 1 delivers the lubricating oil both to the pipe 10 and also to the by-pass pipe 12 so that lubricating oil from the pipe 10 passes through the grooves 40 into the pressure chamber 39 and can act on the spool 18 and urge it into its first position, since the valve member 28 is closed. In this way there is a connection, through the groove 26 of the spool 18 and the ports 60 and 61, between the by-pass pipe 12 and the lubricating oil pipe 15, whilst the connections both between the pipe 10 and cooler 11 via the port 59 and the pipe 15 via the port 61 and also between the lubricating oil pipe 16 and the cooling oil pipe 7 via the ports 62 and 63 are cut off. In this first position uncooled lubricating oil flows in the direction of the arrow to the bearings of the engine and the cooling of the lubricating oil and also the cooling of the piston are prevented so that the operating temperature can be reached relatively rapidly. Then with increasing operating temperature the lubricating oil and the surrounding components of the engine are warmed up.

Figure 3:
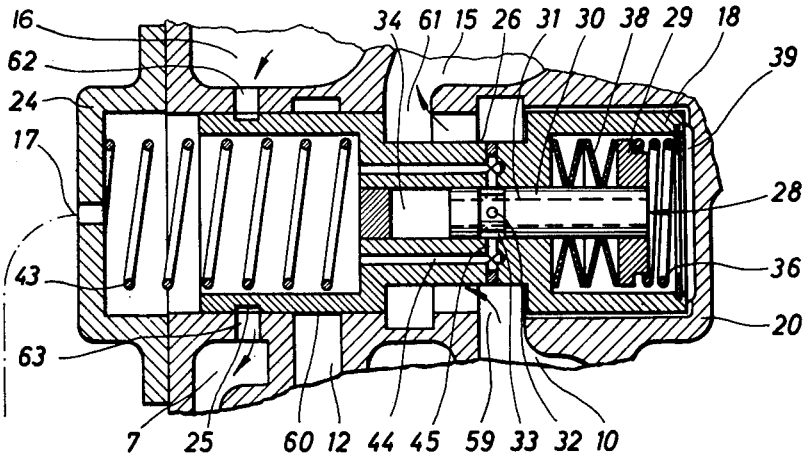
FIG. 3 shows the control member of FIG. 2 in a second operative position.

As shown in FIG. 3, in which only the region immediately around the valve spool 18 is illustrated the bimetallic discs 38 of the valve member 18 of FIG. 2 have lifted head plate 29 of the valve 28 against the force of the spring 36 under the influence of the heat of the engine and the groove 33 of the piston-like stem 30 has been brought into line with the radial bores 45 in the spool 18, and accordingly there is freedom for flow from the pressure chamber 39 in a direction towards the return pipe 17 in the cover 24. This causes a fall in the pressure in the lubricating oil in the chamber 39 and the oil trapped in the chamber 39 can flow away through the bore 31, the bores 44 and the return pipe 17 allowing the spool 18 to be shifted by the spring 43 into the second position as illustrated. In this second position, which is also shown in FIG. 1, the connection between the by-pass pipe 12 via the port 60 and the lubricating oil pipe 15 via the port 61 is cut off by the control slide 18 whilst, through the groove 26 and the ports 59 and 61, the connections both between the pipe 10 and the cooler 11 and the lubricating oil pipe 15 and also through the groove 25 and the ports 62 and 63 between the lubricant pipe 16 (FIGS. 1 and 2) and the cooling oil pipe 7 are completed. In this way the lubricating oil fed in the direction of the arrow to the bearings of the engine is cooled in the cooler 11 so that after rapid attainment of the operating temperature, and with the simultaneous introduction of cooling of the piston, any unwanted overheating of the engine is avoided.

Figure 4:
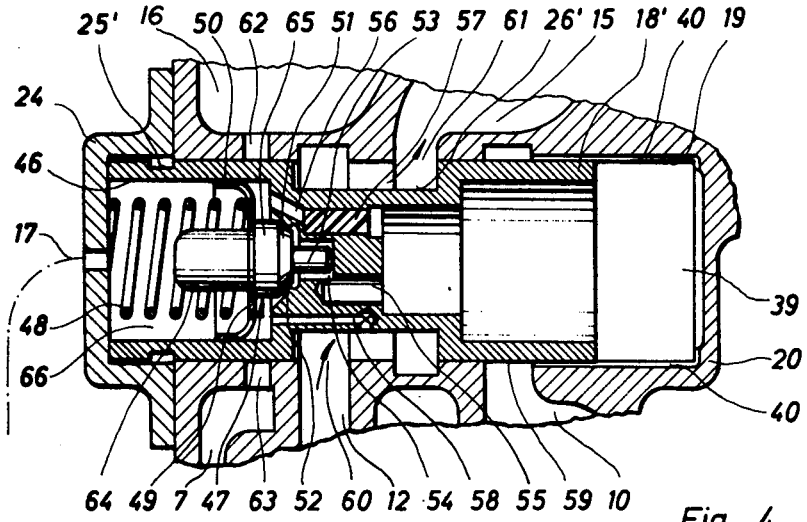
FIG. 4 shows a control member similar to that of FIG. 2 but showing a second embodiment occupying a first operative position.

In the embodiment shown by way of example in FIG. 4 the same reference numerals have been used as in FIG. 2 for the same and similar parts. Differing from the embodiment of FIG. 2 the valve spool is shown at 18' and the grooves at 25' and 26' and likewise there is only shown that region which is essential for the description. In the spool 18', at the end furthest from the pressure chamber 39 and which lies in the return chamber 66 connected to the return pipe 17 and defined by the bore 19 and the cover 24, there is machined a cylindrical axially extending recess 46 in which is mounted a valve assembly 47. In this embodiment the valve assembly 47 comprises an expansion element 64 and a valve member 65, this member 65 being placed between a spring 48, abutting against the cover 24, and the spool slide 18'. Mounted between the spring 48 and the valve assembly 47 there is a thrust ring 49 which has holes through it and has its outside diameter 50 axially slidable in the recess 46 so as to hold the valve assembly 47 in a central position. The valve member 65 has a conical surface 51 which co-operates with a seating 52 provided on the base of the recess 46. The valve assembly 47 is furthermore provided with a pressure pin 53 which projects centrally with respect to the seating 52 from the expansion element 64 and abuts against the end of a deep recess 54 within the seating 52. This recess 54 communicates with the pressure chamber 39 through a laterally offset longitudinal bore 55. In addition substantially parallel to the bore 55, an auxiliary passage 56 leads from the recess 46 into the pressure chamber 39, the auxiliary passage 56 being closed by a fusible plug 57. Moreover there is a further passage 58 connecting the recess 46 to the annular groove 26'.

The spool 18′ occupies the first position, shown in FIG. 4, after a cold start of the engine, i.e. when the lubricating oil delivered by the pump 8 to the by-pass pipe 12 and to the oil pipe 10 can pass through the grooves 40 to the chamber 39 and can act against the end of the spool 18′, and when the pressure pin 53 of the valve 47 has withdrawn under the influence of the low lubricating oil temperature in the expansion element 64, the surface 51 engaging the seating 52 and closing off flow through the bore 55. Corresponding to the embodiment of FIG. 2, there is then a connection through the groove 26′ and via the ports 60 and 61 between the by-pass pipe 12 and the lubricating oil pipe 15 whereas the connections both between the oil pipe 10 from cooler 11 and lubricating oil pipe 15 via the ports 59 and 61 and also between the pipe 16 (FIGS. 1 and 2) and the cooling oil pipe 7 via the ports 62 and 63 are cut off. As the lubricating oil is not cooled in this first position and also there is no cooling of the piston, the temperature of the oil and the overall temperature of operation can rise relatively rapidly. Since during this operating condition a certain quantity of warmed lubricating oil can always flow from the groove 26′ through the passage 58, and can flow back through the return passage 17, the expansion element 64 is acted on directly by the lubricating oil and influenced by the temperature of the oil itself, so that opening of the valve 47 can be achieved without delay.

Figure 5:
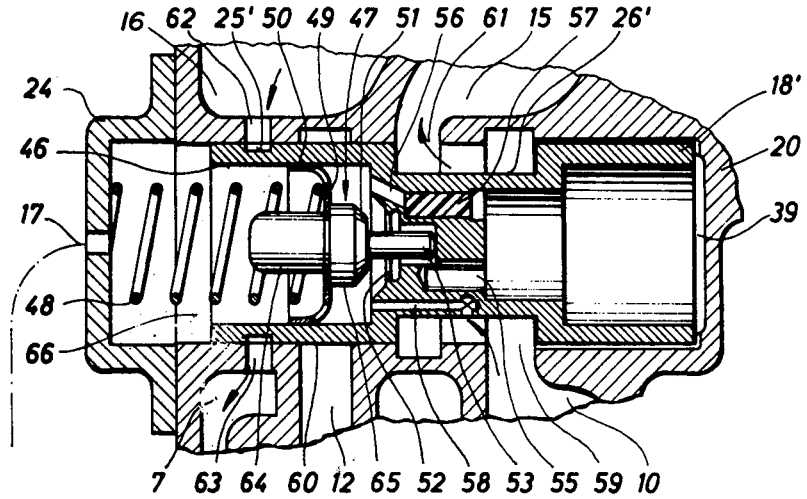
FIG. 5 shows the control member of FIG. 4 in a second operative position.

FIG. 5 shows the second position of operation of the embodiment described in FIG. 4. It will be seen that the valve assembly 47 and expansion element 64, over which lubricating oil flows, have lifted away under the influence of the warmth of the lubricating oil by outward displacement of the pressure pin 53 with resulting displacement of the thrust ring 49 in the recess 46 away from the valve seating 52, allowing the oil in the chamber 39 to flow through the bore 55 into the return chamber 66 and thence to the return pipe 17 and the spool 18′ is displaced by the spring 48 into the position shown, as also in the embodiment of FIG. 3, the valve spool 18′ cuts off the communication between the by-pass pipe 12 via the port 60 and the lubricating oil pipe 15 via the port 61, whereas through the groove 26′ and the ports 59 and 61 the connections both between the lubricating oil pipe 10 and cooler 11 and the pipe 15 and also through the groove 25′ and the ports 62 and 63 between the pipe 16 (FIGS. 1 and 2) and the cooling oil pipe 7 are effected. However in this position oil coming from the pipe 10 and cooler 11 can also flow through the groove 26′ via the passage 58 into the return chamber 66 containing the expansion element 64 and flow away through the return pipe 17, and so also in this condition of operation the valve 47 and element 64 are acted on directly by the lubricating oil and, for example with a fall in temperature, can close without delay.

In the event of failure of the valve assembly 47 and the valve thus remaining in the first operative position, shown in FIG. 4, increasing temperature of the oil flowing through the groove 26 can melt the plug 57, inserted as a safety precaution, and result in communication between the pressure chamber 39 and the return pipe 17 so that the spool 18′ is displaced into the second operative position, shown in FIG. 5, in which cooling of the piston through the pipe 7 is ensured.

The invention is not limited to the embodiment illustrated; for example it is also possible for the piston engine shown in the example to be made up of several cylinders with a corresponding number of spray nozzles 6. The engine could, it will be understood, equally well be a rotary piston engine. Again, the valve 28 or 47, instead of being mounted in the spool slide 18 or 18′ could be mounted at a point in the housing 20 somewhere between the pressure chamber 39 and the return pipe 17.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed:

1. An arrangement for controlling the oil flow in an internal combustion engine having bearings connected to a lubricating oil circuit and a piston cooled by a cooling oil circuit which is branched off said lubricating oil circuit, said lubricating oil circuit comprising a pump, a cooler connected on one hand to said pump and on the other hand to a lubricating oil pipe, a bypass pipe bypassing said cooler, and control means responding to the oil temperature and having a first position below a certain oil temperature for connecting said lubricating oil pipe to said bypass pipe and simultaneously disconnecting said lubricating oil pipe from said cooler, and a second position at and above said temperature for disconnecting said lubrication oil pipe from said bypass pipe and simultaneously connecting said lubricating oil pipe to said cooler, said control means being interposed also in said cooling oil circuit for cutting off and opening, respectively, said cooling oil circuit in the first position and second position, respectively, of the control means.

2. An arrangement according to claim 1, wherein said control means includes a housing having a bore, a valve spool arranged to slide in said bore between said first and second positions and having at one end a piston face delimiting a pressure chamber at one end of said bore with the pressure in said chamber tending to urge the valve spool to its first position, a spring acting on said valve spool and tending to urge it to its second position, ports in said housing controlled by said valve spool for connecting and disconnecting, respectively, said bypass pipe to said lubricating oil pipe, disconnecting and connecting, respectively, said cooler to said lubricating oil pipe and cutting off and opening, respectively, the cooling oil circuit in the first and second position, respectively, of the spool valve, said pressure chamber being in continuous connection with said pump, and temperature-responsive valve means for connecting said pressure chamber to a return pipe when said certain oil temperature is reached so that said spring is capable to urge said valve spool to its second position.

3. An arrangement according to claim 2 wherein the valve spool has a longitudinal bore communicating through transverse bores with the return circuit, and said temperature-responsive valve means comprising a piston-like valve member with a longitudinal passage mounted within the longitudinal bore with the longitudinal passage opening into the pressure chamber, said passage, in a first operative position, connecting the pressure chamber to the transverse bores and in a second position closing off this connection, the piston-like valve member having a head lying in the pressure chamber, a head spring abutting the head, the head spring urging the valve member into its second position, and bimetallic discs mounted between the valve head and a face on the spool and acting to bring the valve member into its first position at a predetermined temperature against the action of the head spring.

4. An arrangement according to claim 2 wherein the housing has a cylindrical bore and a wall therefor, the valve spool is cylindrical and slides in the cylindrical bore in the housing, that there are provided in the wall of the cylindrical bore a first port connected to the cooler, a second port connected to the by-pass pipe, third and fourth ports connected to the lubricating oil pipe and a fifth port connected to the cooling oil circuit, and the spool has on its external surface a first and a second annular groove, and in the first position the first groove connects the second port to the third port, whilst the remaining ports are cut off by the spool and in the second operative position the first groove connects the first port to the third port and the second groove connects the fourth port to the fifth port whilst the second port is closed off by the spool.

5. An arrangement according to claim 2 wherein the spool has a longitudinal bore and the end of the spool which is furthest from the pressure chamber lies in a return space which communicates with the return pipe, this space communicating with the pressure chamber through the longitudinal bore in the spool, the temperature-responsive valve means being mounted in the return space and having a valve member co-operating with the mouth of the longitudinal bore, this valve member being urged in a closing direction by the spring acting on the spool and being secured to a thermal element which lifts the valve member away from the mouth of the longitudinal bore at a predetermined temperature.

6. An arrangement according to claim 5 wherein a passage is provided in the valve spool, opening on the one hand into the return space and on the other hand connected, in the first operative position, to the by-pass pipe and, in the second operative position, to the cooler.

7. An arrangement according to claim 5 wherein there is provided in the valve spool an auxiliary passage which connects the pressure chamber side to the return space and in which is mounted a fusible plug that closes off the auxiliary passage.

* * * * *

UNITED STATES PATENT AND TRADEMARK OFFICE

CERTIFICATE OF CORRECTION

PATENT NO. : 4,114,571

DATED : September 19, 1978

INVENTOR(S) : Max Ruf

It is certified that error appears in the above-identified patent and that said Letters Patent are hereby corrected as shown below:

Face Page of Patent; Above the Abstract, "Attorney, Agent, or Firm - Miller & Prestia" should read -- Attorney, Agent, or Firm - Kane, Dalsimer, Kane, Sullivan and Kurucz --

This patent should be assigned to: AUDI NSU AUTO UNION AKTIENGESELLSCHAFT.

Signed and Sealed this

First Day of May 1979

[SEAL]

*Attest:*

RUTH C. MASON
*Attesting Officer*

DONALD W. BANNER
*Commissioner of Patents and Trademarks*